US012611570B2

(12) United States Patent
Kim

(10) Patent No.: US 12,611,570 B2
(45) Date of Patent: Apr. 28, 2026

(54) EXERCISE METHOD AND DEVICE

(71) Applicant: Eun Bee Kim, Chuncheonsi (KR)

(72) Inventor: Eun Bee Kim, Chuncheonsi (KR)

( * ) Notice: Subject to any disclaimer, the term of this patent is extended or adjusted under 35 U.S.C. 154(b) by 130 days.

(21) Appl. No.: 18/636,327

(22) Filed: Apr. 16, 2024

(65) Prior Publication Data

US 2025/0058170 A1 Feb. 20, 2025

Related U.S. Application Data

(62) Division of application No. 17/928,325, filed on Nov. 29, 2022, now abandoned.

(51) Int. Cl.

*A63B 23/04* (2006.01)
*A63B 21/00* (2006.01)
*A63B 23/035* (2006.01)

(52) U.S. Cl.

CPC ..... *A63B 23/0405* (2013.01); *A63B 21/154* (2013.01); *A63B 21/4034* (2015.10); *A63B 21/4045* (2015.10); *A63B 21/4047* (2015.10); *A63B 23/03533* (2013.01); *A63B 2208/0233* (2013.01); *A63B 2208/0242* (2013.01)

(58) Field of Classification Search

CPC . A63B 22/06; A63B 22/0605; A63B 22/0664; A63B 21/4045; A63B 2022/0611; A63B 2022/0617

See application file for complete search history.

(56) References Cited

U.S. PATENT DOCUMENTS

| | | | | |
|---|---|---|---|---|
| 4,446,754 A * | 5/1984 | Chattin | B62M 3/04 | 74/594.3 |
| 4,807,491 A * | 2/1989 | Stuckenbrok | B62M 3/04 | 74/594.1 |
| 5,755,645 A | 5/1998 | Miller et al. | | |
| 7,350,796 B2 * | 4/2008 | Misevski | B62M 3/06 | 280/260 |
| 2011/0300997 A1 * | 12/2011 | Ilett | A63B 24/0062 | 482/80 |
| 2024/0366995 A1 * | 11/2024 | Heidecke | A63B 22/0025 | |

FOREIGN PATENT DOCUMENTS

| | | | |
|---|---|---|---|
| CN | 108671471 A * | 10/2018 | F03G 5/02 |
| CN | 116832397 A * | 10/2023 | A63B 22/0605 |
| KR | 101952412 | 2/2019 | |

* cited by examiner

*Primary Examiner* — Joshua T Kennedy

(57) ABSTRACT

The present invention relates to an apparatus for strengthening thigh and hip muscles. The apparatus according to the present invention enables a user to perform a movement in which a portion of the body connected to an arm rotates by using hip joint of the user as a pivot axis and simultaneously enables the user to perform a movement of compressing legs by providing the arm having one end connected to the pivot axis wherein the pivot axis is located close to a seat and allows a length of the arm to be extended and then restored according to a rotation angle.

4 Claims, 17 Drawing Sheets

EXERCISE METHOD AND DEVICE

TECHNICAL FIELD

The present invention relates to an exercise method and an exercise device for performing an exercise suitable for thigh and hip muscles such as fitness equipment and an exercise bicycle, and more particularly to an exercise method and an exercise device for strengthening thigh and hip muscles by performing a movement of lowering legs and then moving the legs backward or putting the legs together or apart from a position of pulling the legs toward a chest of the user with an arm disposed between the legs in a sitting or lying position of the user.

BACKGROUND ART

In general, as illustrated in FIG. 1, an exercise for strengthening thigh and hip muscles is performed by pulling legs toward a chest and compressing the legs to the outside by using a pelvis as an axis. However, since a typical exercise method and an exercise device directly transmit a load to an ankle and a knee, ankle and knee joints may be damaged, and a person having weak ankle and knee joints may not perform the exercise method.

In addition, a typical bicycle that is generally used by a knee patient has been developed to go faster more distance with a less force. Thus, as illustrated in FIG. 2, since the bicycle has a pivot axis disposed around an ankle, an exercise is concentrated on lower legs and gives a small effect on upper legs and a hip joint. Thus, a prior bicycle of this inventor expands an exercise range suitable for a motion range of knee joints and the hip joint and increase the exercise effect to be used for exercises. Specifically, the prior invention of the inventor expands a motion range of the hip joint and the knees by arranging an arm pivot axis of the prior exercise device in parallel to the hip joint in a corresponding manner in order to use the bicycle for exercises.

Also, as a foot plate or a foot pad of the exercise device connected to a weight is positioned on a thigh of an exercising leg, and a movement of raising the exercising leg toward a chest and rotating the leg backward in a sitting or lying position of the user is performed, a force transmitted to the knee and the ankle decreases.

TECHNICAL PROBLEM

As illustrated in FIG. 2, a typical fixed-type bicycle that is generally used by a user who has a weak knee has an insignificant effect of strengthening a hip joint because a motion range of the hip joint is restricted, and an axis of a movement is fixed (an exercise range of about 10 to 20). As illustrated in FIG. 1, a general motion range of the hip joint of a human is about 120°. Thus, the prior invention of this inventor expands the motion range such that a pivot axis of an exercise device is disposed parallel to a position of a hip joint of a body of a user, and the user performs an exercise of lowering thighs and moving the thighs backward from a start position of pulling the thighs to a chest of the user. However, the exercise device according to the above-described invention shows a few problems. Thus, technical objects will be described below.

First, the exercise device according to the invention has inconvenience in that the user is necessary to change a seat position during exercises when a single arm and a single pivot part are provided so that a seat does not disturb rotation of the arm, and a pivot axis of the arm corresponds to a hip joint (first problem).

Second, the prior exercise device, in which the pivot axis and the hip joint are disposed parallel to perform a movement of lowering legs and moving the legs backward from a start position in which the user sits on the seat, places the legs on one end of the arm, and pulls the legs toward the chest of the user, causes discomfort because a length of the arm of the exercise device contacting the body is changed according to a rotation angle of the hip joint or the knee joint. For example, a distance from the pivot axis to the pedal decreases when the legs are raised, and the distance increases when the legs are lowered. However, a length of the arm is fixed to cause discomfort. Also, knees are over-bent or over-extended to generate side effects. Thus, the length of the arm is necessary to be varied according to the variation of the length of the leg to the pivot axis.

Third, the exercise device according to the prior invention causes discomfort because the pedal rotates by using a bar as an axis when a foot is placed on the pedal to perform a linear movement.

Fourth, in case of a typical bicycle, the arm rotates by 360° to automatically move from an exercise end section to an exercise start section. In case of the exercise device according to the prior invention, the exercise section is within 180°, the arm does not return from the end section to the start section.

Fifth, in case of an axis conversion device of the exercise device according to the prior invention, when a roller connected to a resistance body is hinged from x-axis parallel to the ground to a y-axis perpendicular to the ground, the roller is easily worn because a wire is not fixed to the roller, and thus the wire hits the roller.

SUMMARY

In order to solve the second problem, the exercise device according to the present invention performs a movement in which a portion of the body connected to an arm rotates and simultaneously compresses by providing a shock absorber to the arm having one end connected to a pivot axis and allows a length of the arm to be extended and then restored through the shock absorber when a length of legs are changed according to a rotation angle. The shock absorber may have a gas cylinder shape and apply a resistive force by a spring in addition to gases (KR 10-2021-0040066).

In order to solve the third problem, The exercise device according to the present invention is configured such that as a pipe and a bar that linearly moves in the pipe are provided to the arm instead of the shock absorber, a portion of the body connected to the arm rotates and simultaneously compresses, and the length of the arm is extended and then restored to an original state through the pipe and a bar 11 that linearly moves in the pipe. In addition, as a second pipe 22 connected parallel to the pipe is provided, a second bar 21 is provided in the second pipe, and a second bar fixing body 20 is provided on the bar, when the bar linearly moves from the inside to the outside of the pipe, the second bar also linearly moves from the inside to the outside of the pipe, so that the pedal 5 does not rotate about the bar (KR 10-2021-0046163,KR 10-2021-0046813). Through the above-described invention, an effect of simultaneously performing a rotation exercise and a compression exercise is generated.

In order to solve the fourth problem, the exercise device according to the present invention is configured such that as the axis is separated into a left side and a right side, and the left and right sides are organically connected by using a gear and a roller, the exercise device is returned from an exercise end section to an exercise start section (KR 20-2020-0152414).

In order to solve the fifth problem, the exercise device according to the present invention is configured to move on an x-axis parallel to the ground and rotate on a y-axis perpendicular to the ground by using a spiral gear or a bevel gear. In addition, as the gear device is manufactured to have a gear box shape, a user may attach the gear device to an existing exercise device in order to recycle the existing exercise device. Furthermore, as a time belt, a belt, and a sprocket are inserted into a pipe having a rectangular shape or a pipe shape provided below the seat, a belt pulley or a sprocket is connected to the gear device according to the present invention, and the belt pulley is connected to a resistive body of the existing bicycle (KR 10-2020-0152414, KR 10-2020-0153238), (KR 10-2020-0170941, 10-2020-0179121, 10-2021-0002955).

ADVANTAGEOUS EFFECTS

Hereinafter, advantageous effects of the present invention will be described.

First, the exercise device according to the present invention may simply strengthen the thigh and hip muscles instead of changing the position of the seat by the user or providing two arm pivot parts to both the sides (KR20-2020-0001877).

Second, The exercise device according to the present invention increases the exercise effect by applying the rotational force and the compressional force in a complex manner and performs the exercise similar to the natural movement, and when the user performs the exercise of pulling the legs toward the chest and then lowering the legs and rotating backward through the movement in which the bar linearly moves in the pipe, the length of the arm is flexibly extended and then automatically restored according to the substantial variation of the legs contacting the arm during the hip joint pivot exercise (KR 10-2021-0040066).

Third, the left and right arms of the exercise device organically rotate by using the roller and are automatically restored from the exercise end section to the exercise start section.

Fourth, the gear device moves on the x-axis parallel to the ground or rotates on the y-axis perpendicular to the ground by using the bevel gear or the spiral gear to solve the phenomenon of abrasion of the wire connected to the roller, and the resistive body of the existing bicycle may be used by attaching the gear device to the existing bicycle to solidify the technology of the exercise device according to the prior invention and recycle the existing bicycle (KR 10-2020-0152414, KR 10-2020-0153238, KR 10-2020-0163490).

As a result, the user who have the weak knee and ankle joints or the user who wants to strengthen the thigh and hip muscles without strain of the joints may perform the thigh and hip muscle strengthening exercise by using the exercise method and the exercise device to strength the muscles, ultimately reduce the risk of disease such as diabetes, prevent obesity, and promote health after the middle age. Also, the present invention helps to aesthetically shape the body and athletes to improve the sports ability without strain of the knee and ankle joints.

BEST MODE FOR CARRYING OUT THE INVENTION

Figure 1:
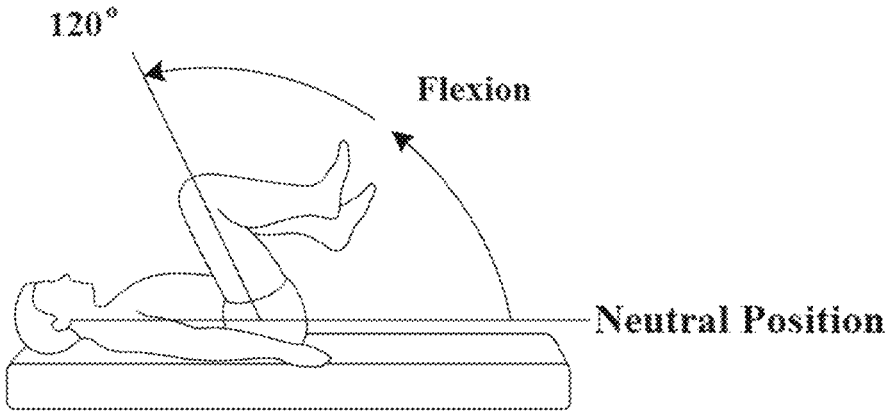
Figure 1 Prior Art
FIG. 1 illustrates general hip rotation using a pelvis as an axis.
Figure 2:
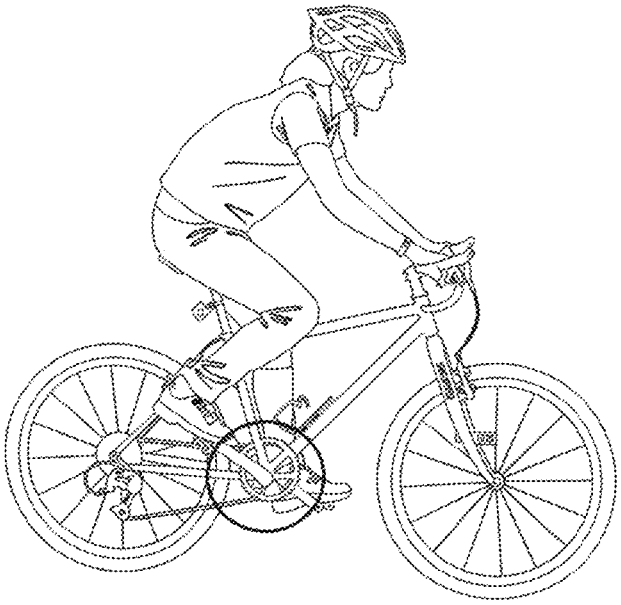
Figure 2 Prior Art
FIG. 2 illustrates the general bicycle pivot axis disposed around an ankle.
Figure 3:
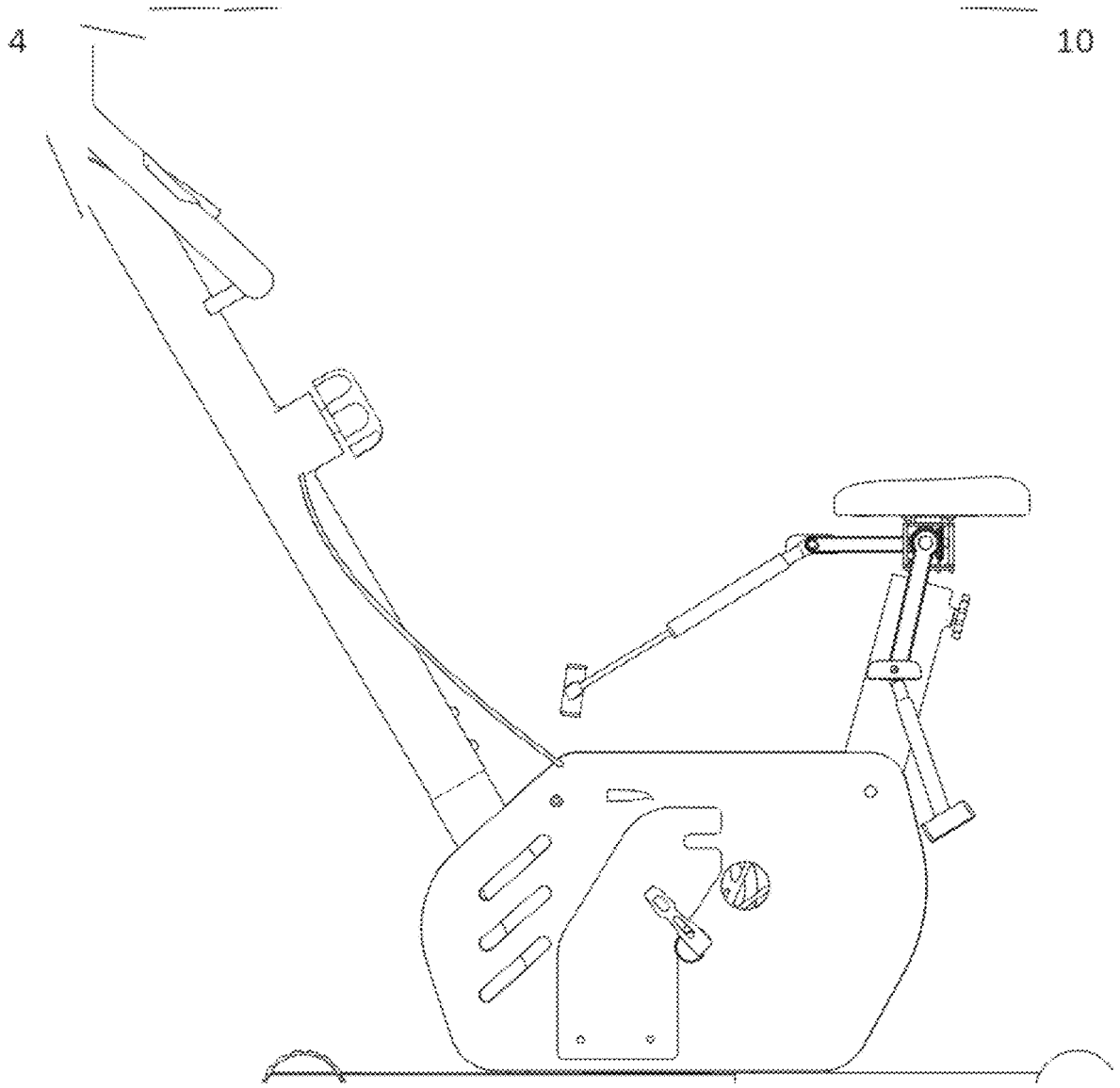
FIG. 3 is a perspective view of an embodiment of the present invention illustrating an arm having an end connected to a pivot axis 11 and a second end coupled to an end of an arm elongation means 12.

Embodiments of the present invention provide an exercise device that is a bicycle, an indoor bicycle, or fitness equipment, the exercise device including a frame 1, a handle 7 connected to the frame, a seat 4 connected to the frame, a pivot axis 11 connected to the frame 1, an arm 10 connected to the pivot axis, a pipe 12*a* connected to the arm, and a bar 12*b*, that linearly moves in the pipe, so that a user performs a movement of lowering legs and moving the legs backward by using a hip joint of the user as an axis from a start position in which the user sits or lies on the seat 4, places the legs on the leg pad, and pulls the legs toward a chest of the user.

DETAILED DESCRIPTION OF THE INVENTION

Hereinafter, detailed descriptions related to well-known functions or configurations will be ruled out in order not to unnecessarily obscure subject matters of the present invention. Since the present invention may, however, be embodied in different forms and various modifications and variations can be made in the present invention, specific embodiments will be described in detail with reference to the accompanying drawings. However, this does not limit the present invention within the specific embodiments and it should be understood that the present invention covers all the modifications, equivalents, and replacements within the idea and technical scope of the present invention. In the following description, the technical terms are used only for explaining a specific example (or embodiment) while not limiting the present disclosure. In the present invention, the meaning of 'include' or 'comprise' specifies a property, a fixed number, a step, an operation, an element, a component, or a combination thereof but does not exclude other properties, fixed numbers, steps, operations, elements, components, combinations thereof.

Hereinafter, an embodiment of a quads and gluteus exercise of the present invention to achieve the above-described objects will be described in detail with reference to the accompanying drawings.

In order to resolve the second problem of the technical object, as illustrated in FIGS. 3 to 6 (KR10-2021-0040066), the exercise device according to the present invention may include: a frame 1; a handle 7 connected to the frame 1; a seat 4 connected to the frame 1; a pivot axis 11 connected to the frame 1 and disposed in parallel to the hip joint of the user; an arm 10 connected to the pivot axis 11; and a shock absorber 12 connected to the arm 10. The exercise device may allow a user to perform an exercise similar to a natural movement of a body of the user by pivoting a portion of a body connected to the arm 10 and simultaneously performing a compression movement, and may be flexibly extended in length and automatically restored based on a different in body length caused by folding and unfolding of the hip joint and knees of the user by installing the shock absorber 12.

The shock absorber 12 may apply a resistive force to the inside thereof by pressing, hydraulic pressure, and spring elasticity according to the typical technology. The shock absorber 12 may be contracted and then extended or extended and then contracted on the contrary. Preferably, the shock absorber 12 may be integrated with the arm 10 or arranged linearly with the arm when viewed on a sagittal plane.

In addition, a muscle resistance according to the pivot exercise may increase by connecting a resistance body to the pivot axis 11. When an embodiment of the present invention is used as an indoor bicycle, a motion range of the bicycle may be extended, and an exercise effect may increase.

Also, an exercise device of the related art in which a pivot axis of an arm is disposed parallel to the hip joint or the knees causes inconvenience because the arm of the exercise device, which contacts a body according to a pivot angle of the hip joint or the knees, has a constant length. For example, since a distance from the pivot axis to the pedal decreases when legs are raised, and the distance increases when the legs are lowered, the fixed length of the arm causes inconvenience, and the knees are over-bent or over-extended to cause side effects. However, in the present invention, the distance may be flexibly extended and then automatically restored according to the difference of the body length when folded and unfolded by installing the shock absorber 12.

In order to resolve the second problem of the technical object, as illustrated in FIGS. 3 to 6 (KR 10-2021-0046163), the exercise device according to the present invention may include: a frame 1; a handle 7 connected to the frame; a seat 4 connected to the frame; a pivot axis 11 connected to the frame 1; an arm 10 pivotably connected to the pivot axis; a pipe 12*a* having a straight line shape and disposed linearly to the arm; and a bar 12*b* having a straight line shape and disposed inside the pipe to vertically move. Here, as the pedal 5 is connected to the bar 12*b*, the user may perform a movement of raising the legs toward the chest and then pivoting the legs around the hip joint and simultaneously pulling and compressing the legs in a state in which the user put the legs on the pedal 5. Through this, as the rotation exercise and the compression exercise are simultaneously performed, the exercise similar to the natural movement of the body may be performed, and when the user sits on the seat 4 to raise the legs toward the chest and then lower the legs and pivot the legs backward through the linear movement of the bar in the pipe, the length of the arm may be flexibly extended and then automatically restored according to the substantial variation in length of the legs contacting the arm caused by the pivoting exercise of the hip joint.

According to a typical technology through a pipe 12*a* and the bar 12*b* disposed in the pipe, the resistive force may decrease by the inner pneumatic pressure or hydraulic pressure or the spring elasticity, and the pipe 12*a* and the bar 12*b* may be contracted and then extended or extended and then contracted on the contrary. Also, a muscle resistance according to the pivot exercise may increase by connecting a resistance body to the pivot axis.

When an embodiment of the present invention is used as an indoor bicycle, a motion range of the bicycle may be extended, and an exercise effect may increase.

Figure 6:
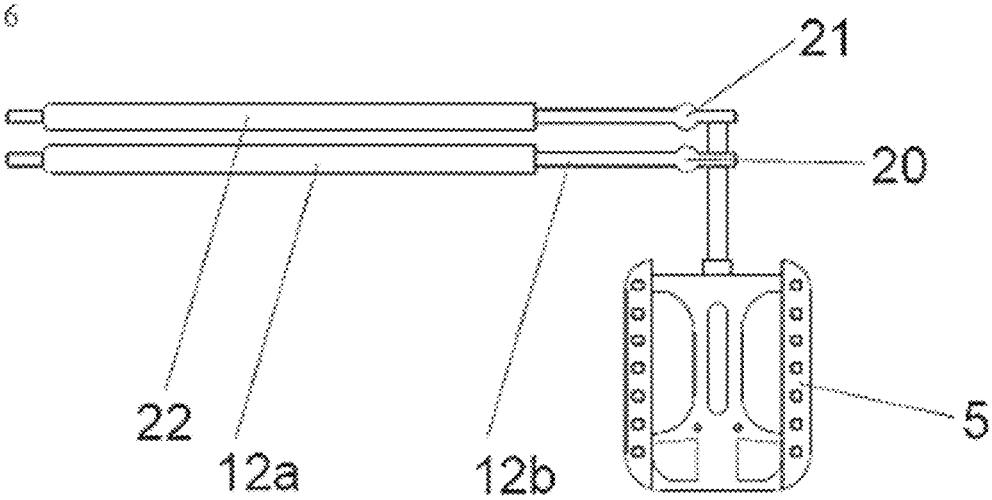
FIG. 6 is a partial view of an embodiment of the present invention illustrating an arm elongation means 12 having a straight line-shaped pipe 12*a* and a straight line-shaped bar 12*b* disposed inside the pipe to move vertically.
Figure 20:
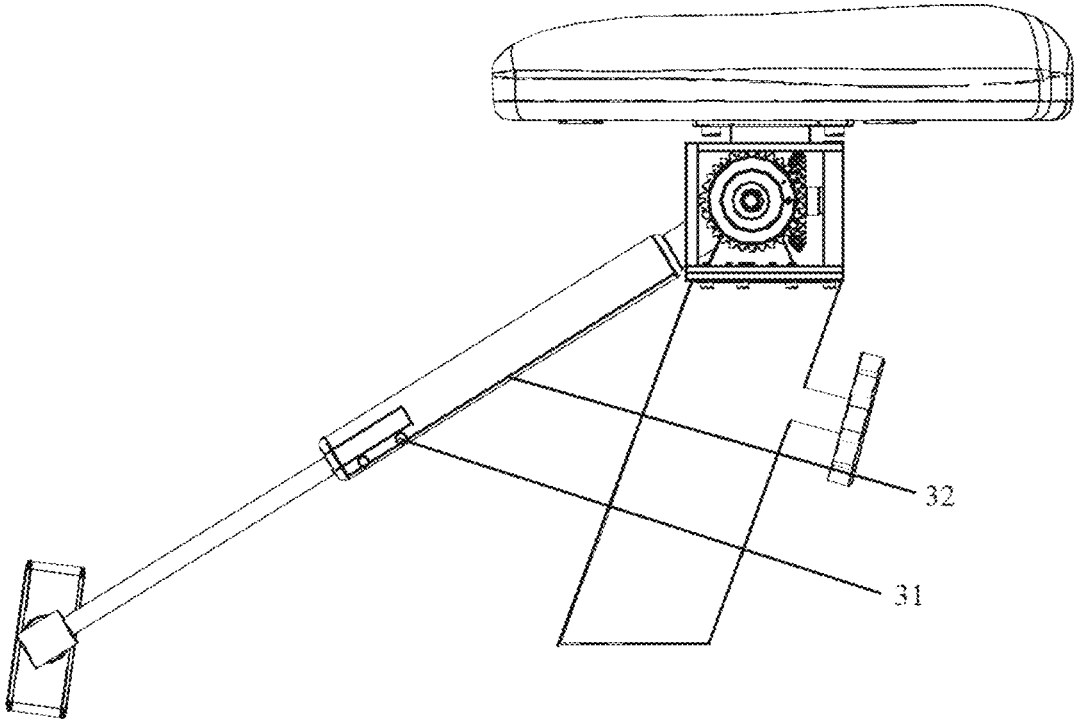
FIG. 20 is a perspective view of an embodiment of the present invention illustrating a guide rail 32, and a roller 31 and a gear device of FIGS. 9-10.

In order to resolve the third problem of the technical object, as illustrated in FIG. 6 (KR 10-2021-0046163), the exercise device according to the present invention may include: a second pipe 22 connected in parallel to the pipe; a second bar 21 disposed in the second pipe; and a second bar fixing body 20 disposed on the bar, so that the pedal 5 does not rotate around the bar as the second bar 21 linearly moves to the outside from the inside of the second pipe 22 when the bar linearly moves to the outside form the inside of the pipe. Thus, when the user performs a compression exercise from a start position of putting the legs on the pedal 5 and pulling the legs, the pedal 5 may linearly moves instead of rotating. In addition, as illustrated in FIG. 20 (KR 10-2021-0046813), the pedal may not rotate around the pipe by selectively providing a guide rail to the pipe 31*a* and a roller 32*a* to the bar and selectively forming a groove in the bar or cutting one surface of the bar and providing a projection on the pipe.

Figure 4:
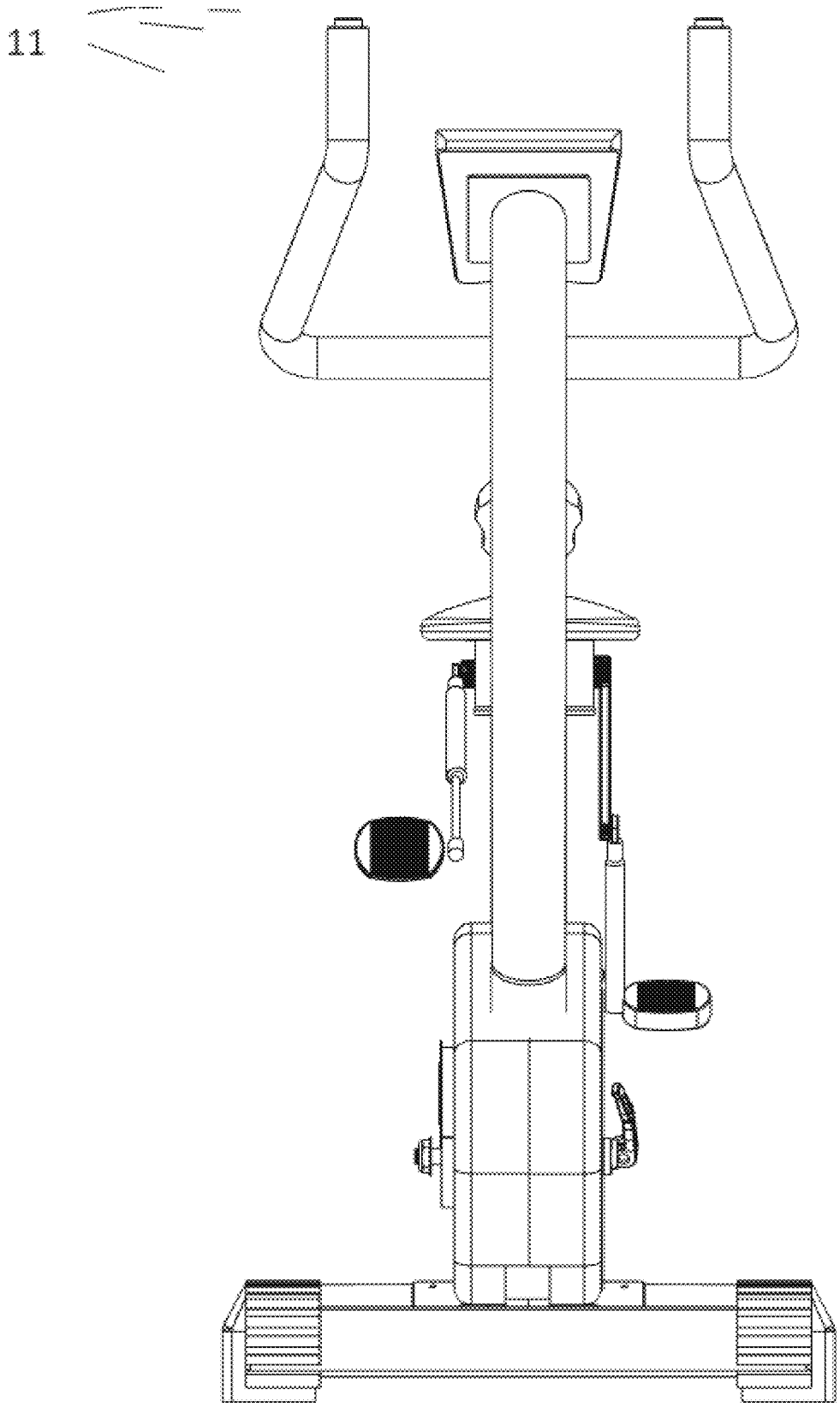
FIG. 4 is a front view of an embodiment of the present invention illustrating an arm 10 having an end connected to a pivot axis 11 and a second end coupled to an arm elongation means 12.
Figure 5:
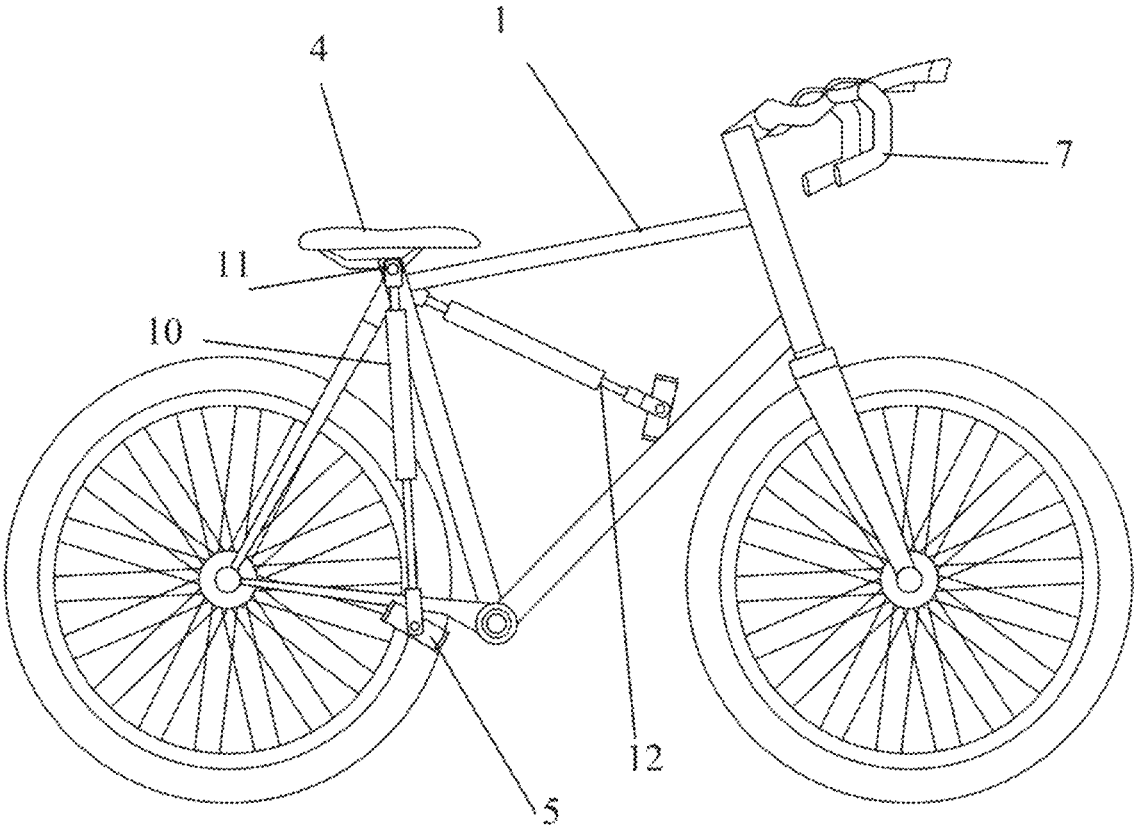
FIG. 5 is a side view of an embodiment of the present invention illustrating an arm 10 having an end connected to a pivot axis 11 and a second end coupled to an end of an arm elongation means 12 arranged linearly with the arm 10.
Figure 7:
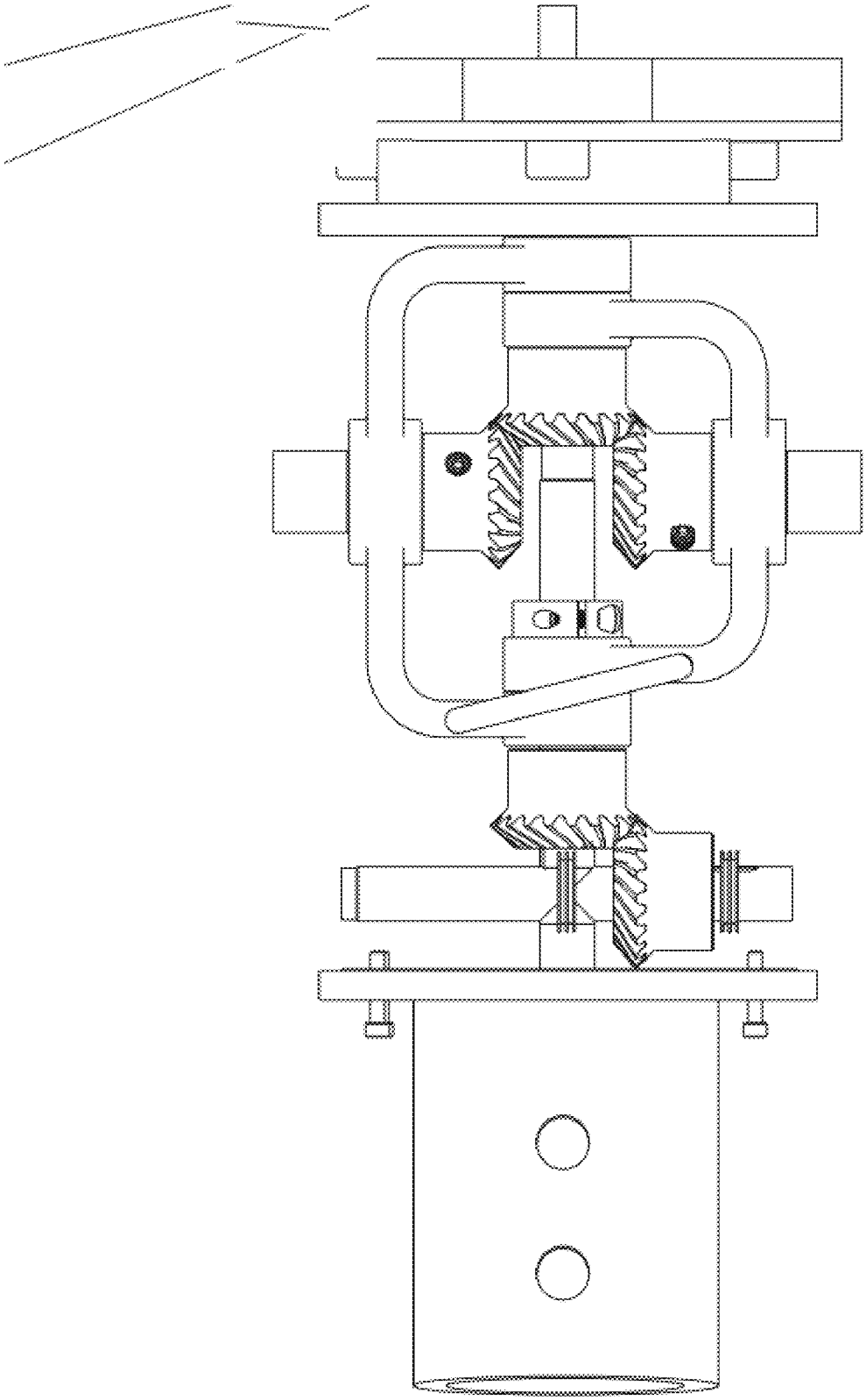
FIG. 7 is a partial view of an embodiment of the present invention illustrating an axis conversion gearbox.
Figure 8:
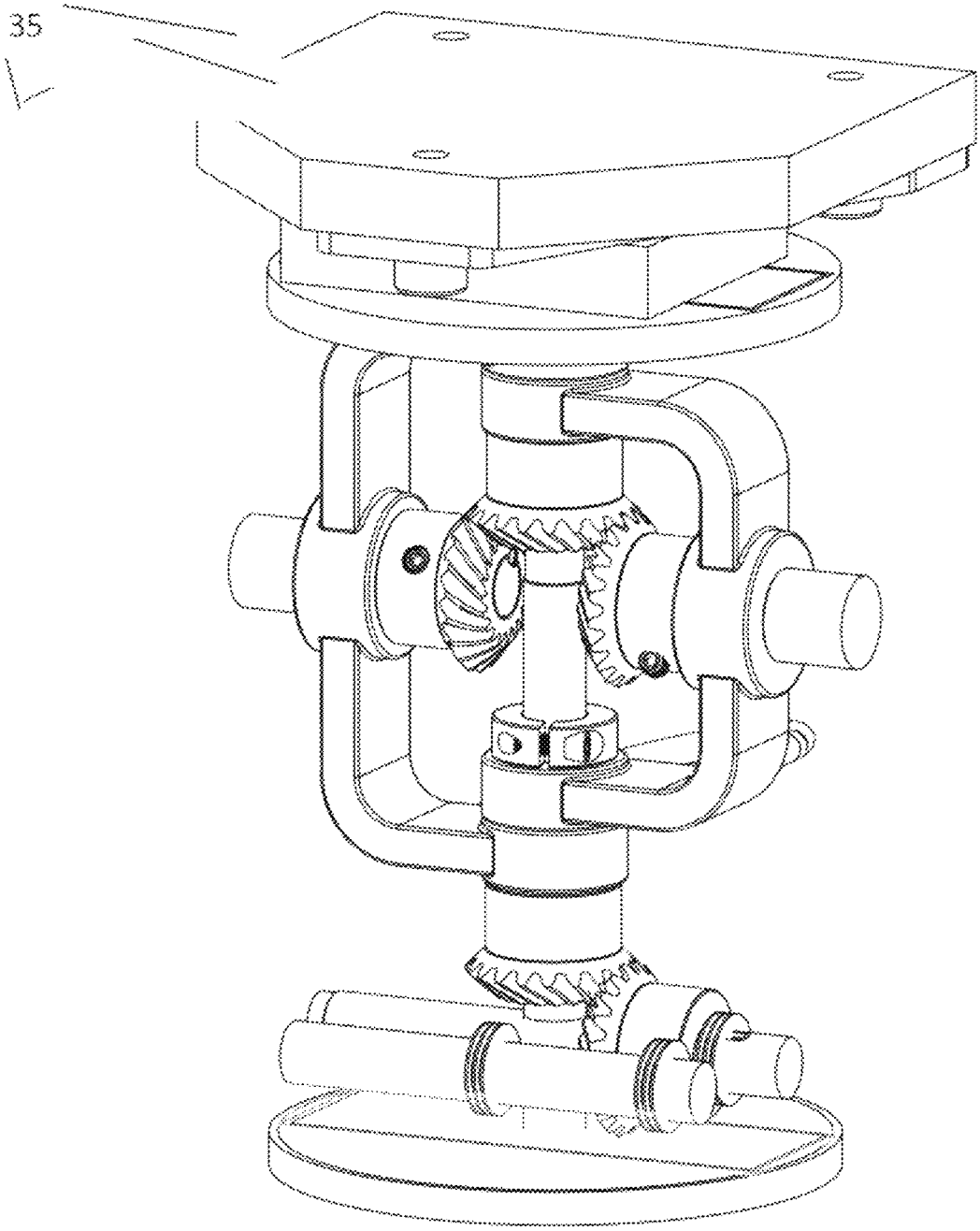
FIG. 8 is a partial view of an embodiment of the present invention illustrating an axis conversion gearbox.
Figure 9:
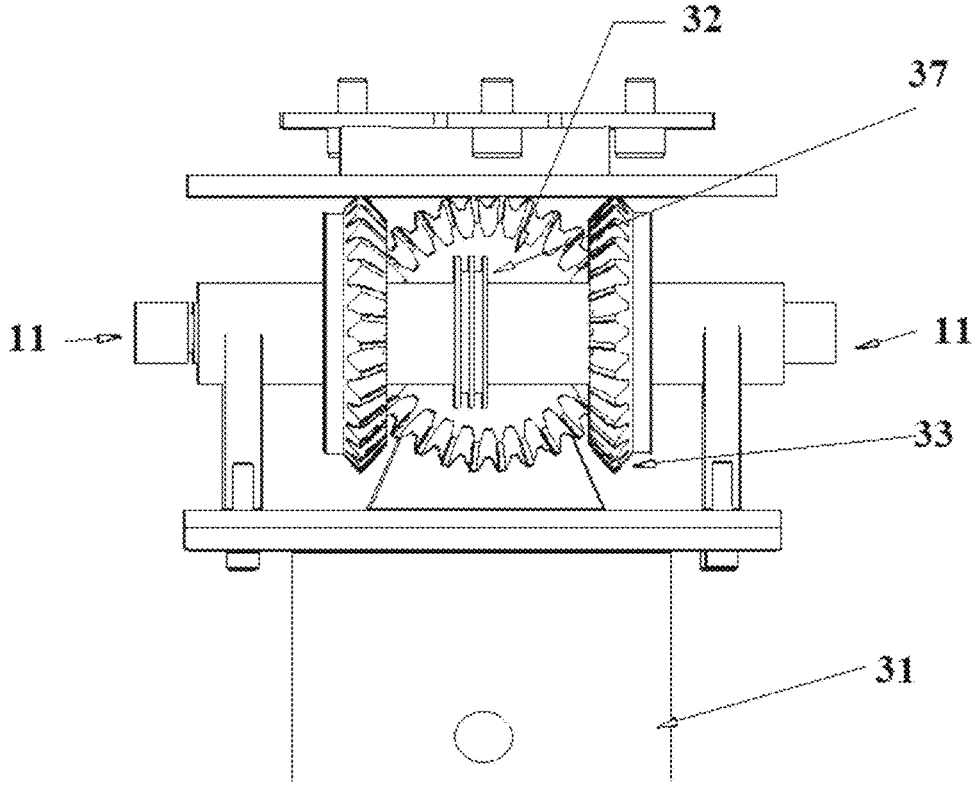
FIG. 9 is a partial view of an embodiment of the present invention illustrating a gear device in which an axis conversion device is not provided.
Figure 10:
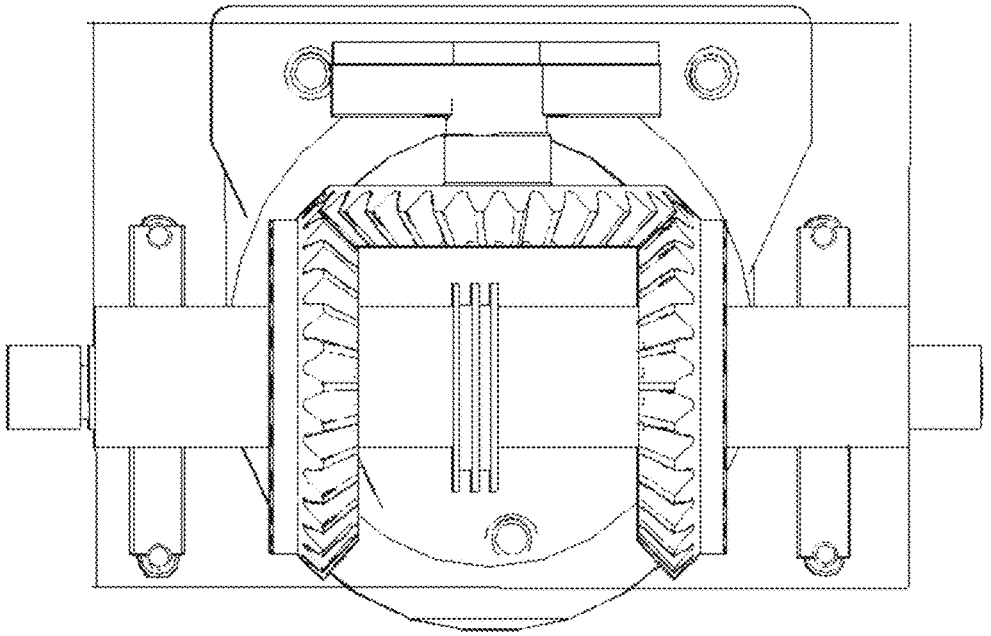
FIG. 10 is a partial view of an embodiment of the present invention illustrating a gear device in which an axis conversion device is not provided.
Figure 16:
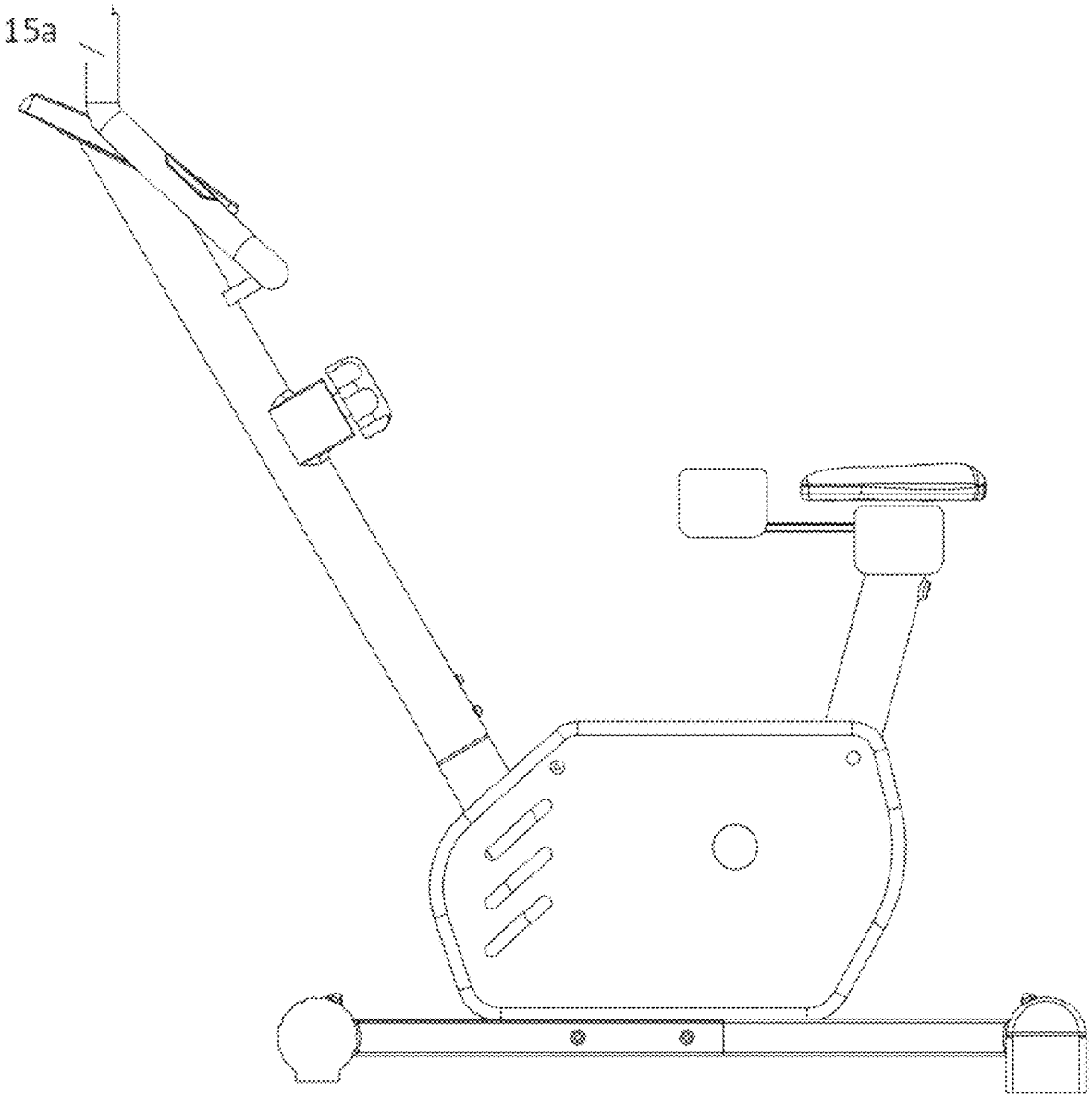
FIG. 16 is a side view illustrating a gear device of an embodiment of the present invention attached to a bicycle.
Figure 17:
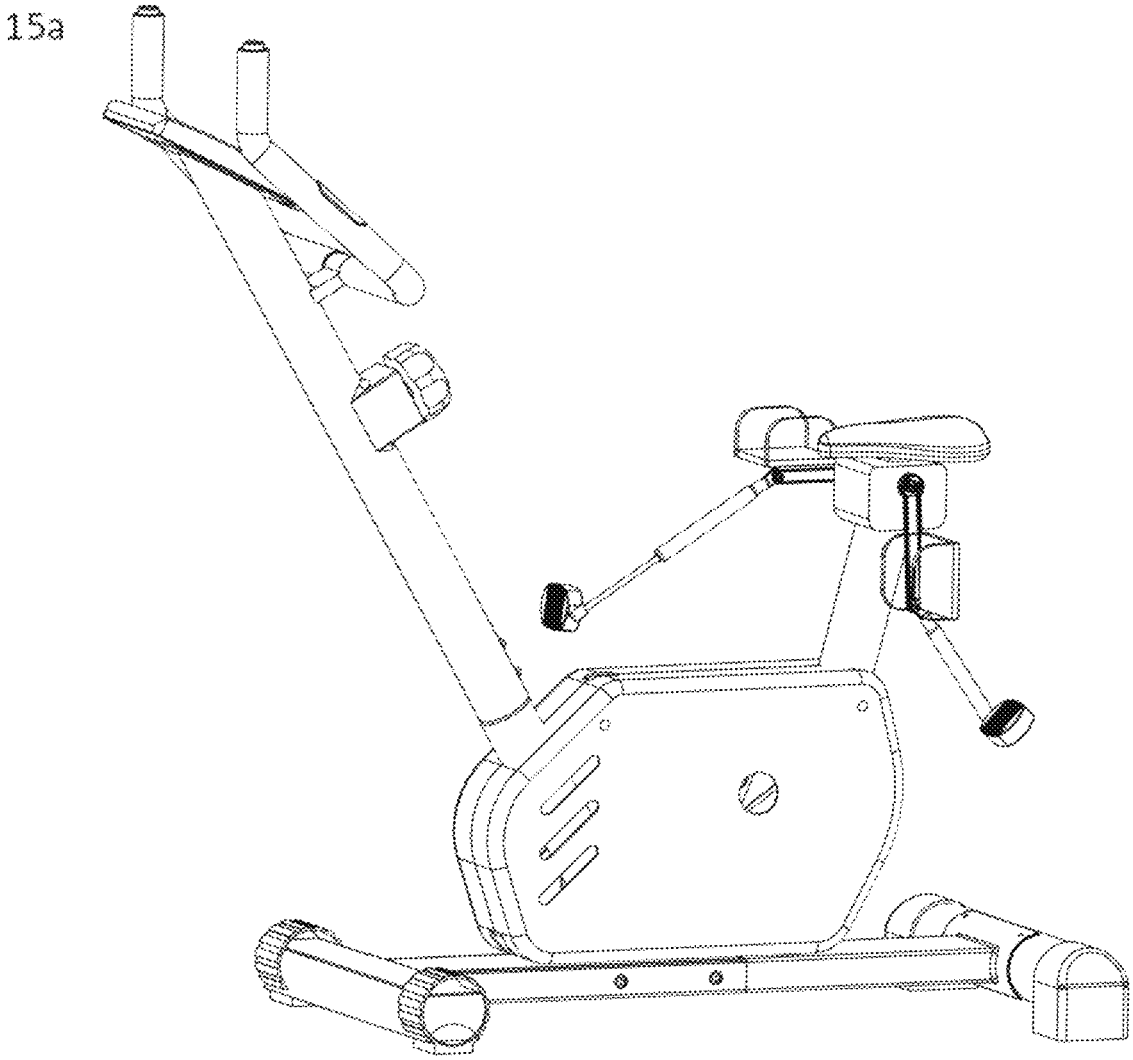
FIG. 17 is a perspective view of an embodiment of the present invention illustrating an axis conversion gear device attached to a bicycle to a leg pad is disposed below the thigh of the user (15*a*)
Figure 18:
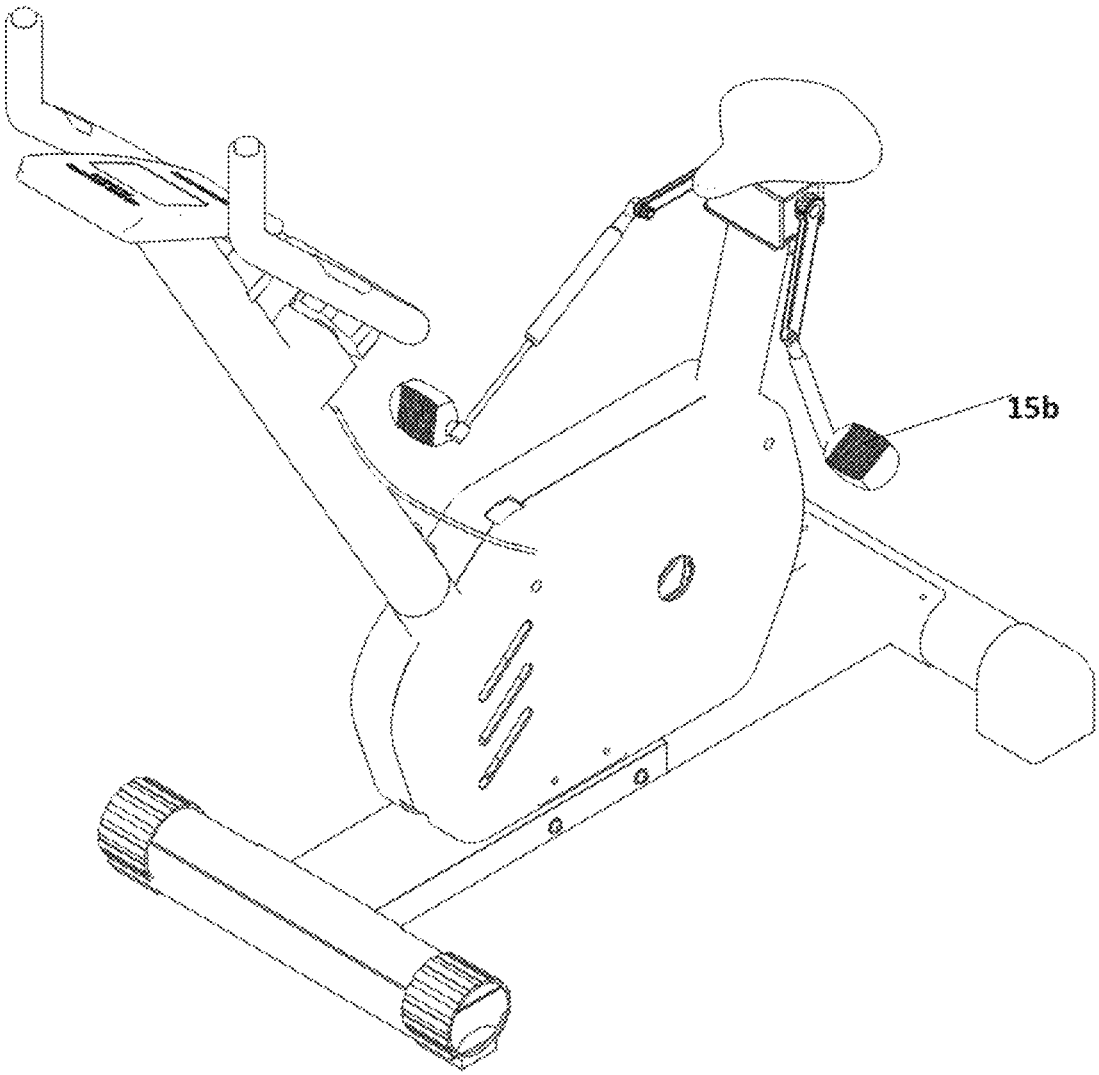
FIG. 18 is a perspective view of an embodiment of the present invention illustrating an axis conversion gear device attached to a bicycle to a leg pad is disposed below the leg of the user (15*b*)

In order to resolve the fourth problem of the technical object, as illustrated in FIGS. 3 to 20, the exercise device according to the present invention may include a gear device allowing left and right arms of the exercise device to organically rotate by using the gear and the roller and be automatically restored from an exercise ending position to the start pose, and to move on the axis parallel to the ground or rotate around the axis perpendicular to the ground, and as the gear device is attached to an existing bicycle to use a resistive body of the existing bicycle, the technology of the exercise device according to the related art may be realized, and the existing bicycle may be recycled. FIGS. 7, 8, 13 to 15 and 19 are views illustrating an axis conversion gear box according to an embodiment of the present invention, and FIGS. 16 to 18 are views illustrating a state in which the axis conversion gear box is attached to an indoor bicycle according to an embodiment of the present invention. FIGS. 9 and 10 are views illustrating a gear box, in which the axis conversion device is not provided according to another embodiment of the present invention. FIG. 4 is a front view illustrating a state in which the gear box according to another embodiment of the present invention is attached to the indoor bicycle.

Figure 11:
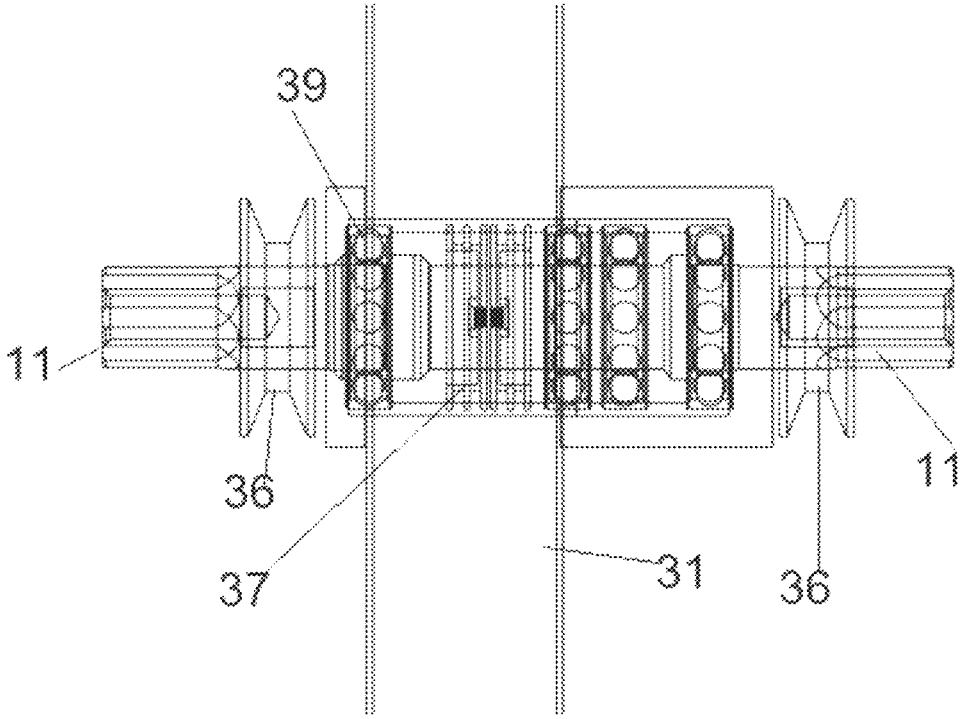
FIG. 11 is a partial view of an embodiment of the present invention, illustrating a gear device using wire and a roller.
Figure 12:
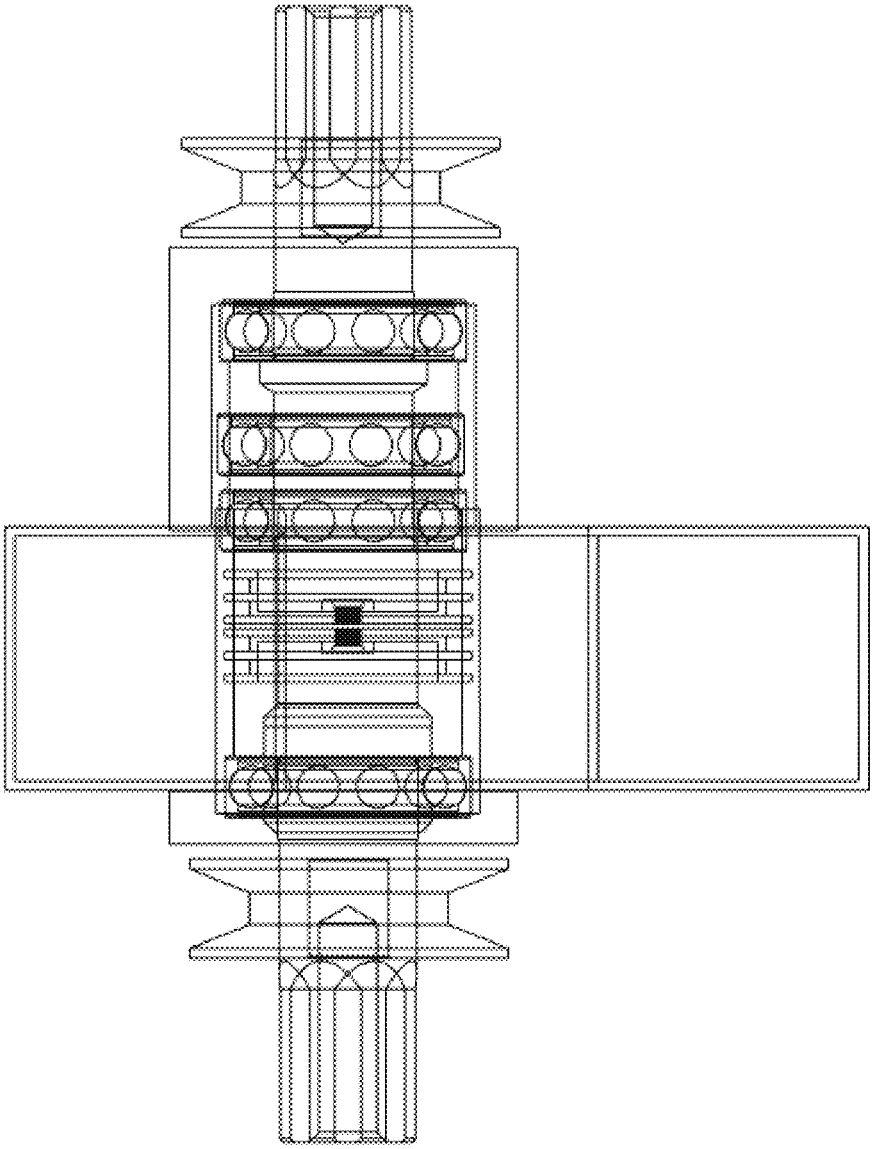
FIG. 12 is a partial view of an embodiment of the present invention, illustrating a gear device using wire and a roller.
Figure 13:
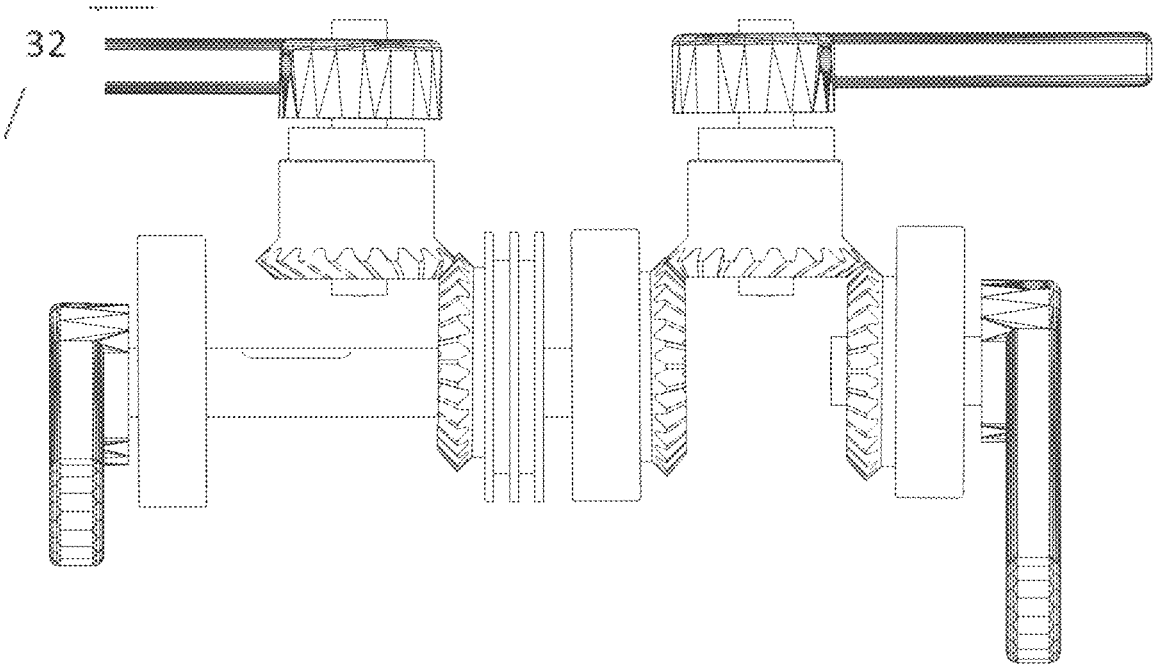
FIG. 13 is a partial view of an embodiment of the present invention illustrating an axis conversion gear device including an arm attached to an x-axis parallel to the ground and simultaneously attached to a y-axis perpendicular to the ground.

FIGS. 11 and 12 are views illustrating the gear box using a wire and a roller according to another embodiment of the present invention. As illustrated in FIGS. 7, 8 and 17, the gear device includes a pivot axis 11, a horizontal spiral gear or bevel gear 32, a vertical gear or bevel gear 33, a second spiral or bevel gear 34, an arm 35 connected to the bevel gear 32 or 33, a roller 36, a tension belt roller 37, a spur gear or a helical gear, a bearing 39, a device 30 for fixing rotation around a y-axis perpendicular to the ground, and a device 31 for fixing the gear device to a vertical frame of another exercise device. Hereinafter, a description on the well-known technology will be omitted.

Figure 19:
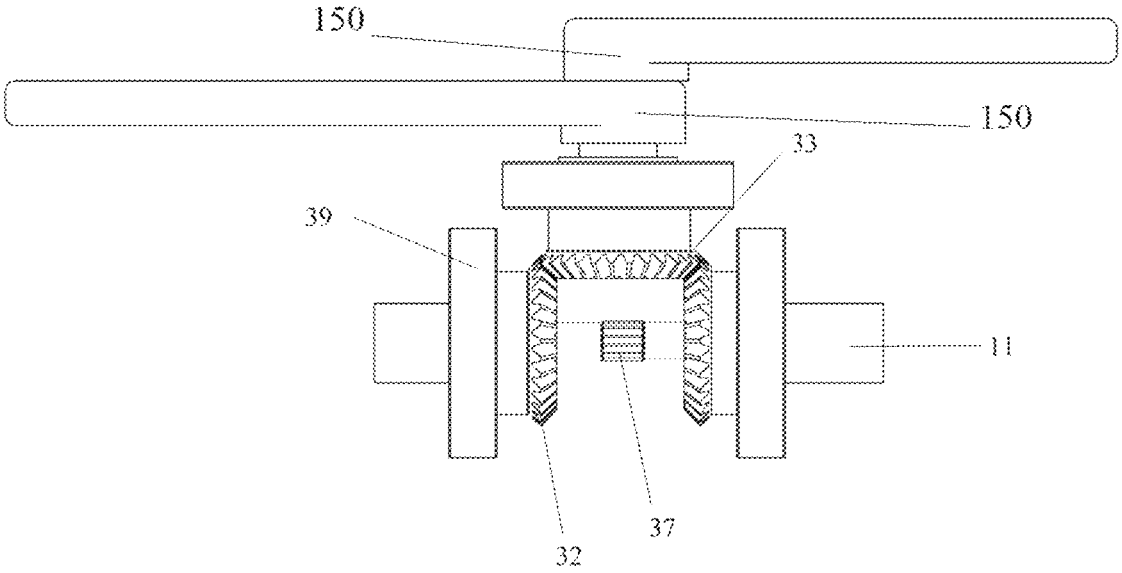
FIG. 19 is a partial view of an embodiment of the present invention illustrating a gear device using a one-way bearing 150.

As illustrated in FIGS. 7 to 8 (KR 10-2020-0163490), the axis conversion gear device according to the present invention may include the arm attached onto a x-axis parallel to the ground and simultaneously attached onto the y-axis perpendicular to the ground and as illustrated in FIG. 19, the axis conversion gear device may include a single y-axis. In addition, as illustrated on FIGS. 7 and 8, the axis conversion gear device may include a through which a right x-axis pivot axis passes; a right arm having an upper end portion and a lower end portion through which a y-axis pivot axis passes; and a left penetrating portion through which a left x-axis pivot axis passes 33, a left arm having an upper end portion and a lower end portion through which the y-axis pivot axis passes 35, wherein the right x-axis pivot axis passes through the right penetrating portion to be rotatable, and the left x-axis pivot axis passes through the left penetrating portion to be rotatable, wherein, in a case of connecting the gear device to a lower body exercise apparatus, when a user fixes the arm to a position parallel to a ground, the user is able to perform a movement of lowering downward or kicking backward about a hip joint as an axis in a starting position of pulling toward a chest, and, when the user fixes the arm to a position perpendicular to the ground, the user is able to close and open a body while placing the body of the user against an end of the arm.

Figure 14:
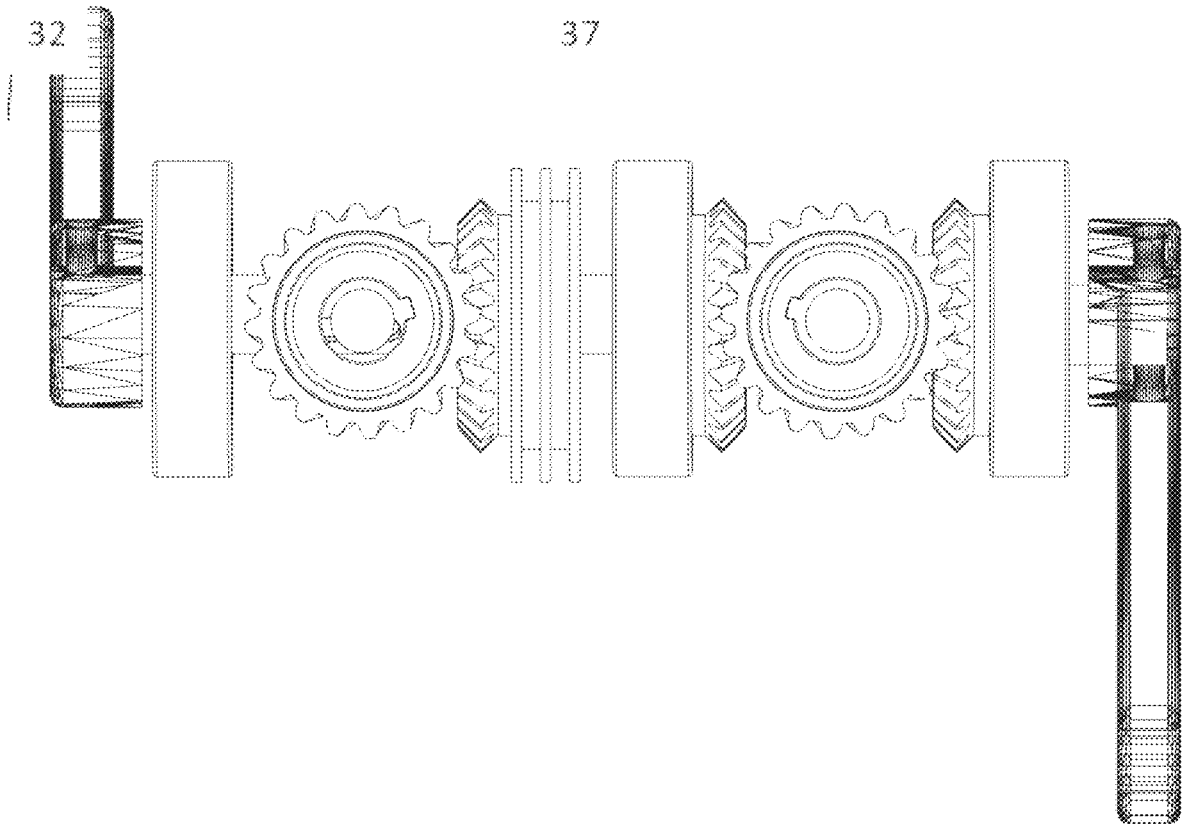
FIG. 14 is a partial view of an embodiment of the present invention illustrating an axis conversion gear device including an arm attached to an x-axis parallel to the ground.
Figure 15:
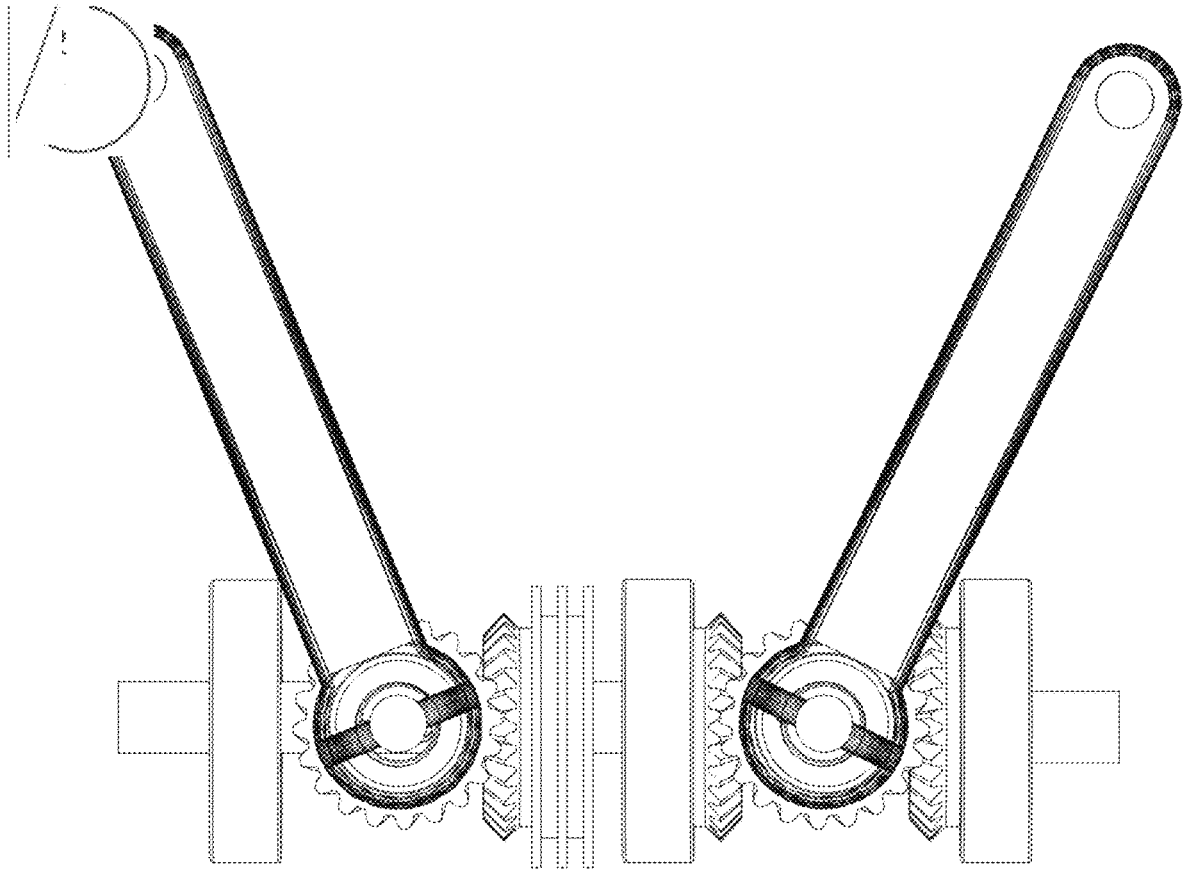
FIG. 15 is a partial view of an embodiment of the present invention illustrating an axis conversion gear device including an arm attached to a y-axis perpendicular to the ground.

Since the axis conversion gear device according to the present invention may include the arm attached onto the x-axis parallel to the ground as illustrated in FIG. 14 and attached onto the y-axis perpendicular to the ground as illustrated in FIG. 15 the user may selectively perform a movement of lowering the legs and moving the legs backward or a movement of putting the legs together. A leg pad may be disposed below the thigh of the user as illustrated in FIG. 17 (15*a*) or disposed below of the legs of the user as illustrated in FIG. 18 (15*b*). The leg pad may have a "⊏"-shape as illustrated in FIG. 17 or a "L"-shape. In addition, (KR 10-2020-0170941), the exercise device according to the present invention is configured such that as a planetary gear is provided to a y-axis pivot device connected to the arm.

As another example of the gear device (KR 10-2021-0002955), as a plurality of shafts and a plurality of arms are provided to the y-axis pivot device, and spur gears are provided to the y-axis pivot device or the arm and engaged with each other, when the one side arm connected to the y-axis pivot device rotates clockwise, the other side arm rotates counterclockwise.

INDUSTRIAL APPLICABILITY

The exercise device according to the present invention may be used for muscle strengthening equipment, an indoor exercise device, a bicycle, an indoor bicycle, a complex exercise device, a band exercise device, and an exercise device gear.

I claim:

1. An apparatus for lower body exercise comprising:

a frame supporting a seat, a pivot axis assembly having a pivot axis proximate to the seat, wherein the pivot axis assembly comprises a housing a bearing and a pivot member, wherein the pivot member comprises a right pivot member and a left pivot member configured to rotate separately from each other, a left arm and a right arm, each arm coupled to the left and right pivot members, respectively, a left arm elongation mechanism and a right arm elongation mechanism coupled to the left and right arms, respectively to allow extension and contraction of the arm, a left pedal and a right pedal rotatably coupled to a distal end portion of the left and right pivot arm elongation mechanisms, respectively; and one or more resistive force generating units, wherein resistive force generated by the one or more resistive force generating units is transmitted to the pivot members and the arm elongation mechanism, wherein, when a user pushes each of the pedals, a length of the each arm increases relative to the each pivot member and subsequently returns to an original length, wherein the apparatus enables the user to simultaneously perform a compressing action by pushing the pedals and perform a movement in which a user's legs rotate vertically about a hip joint as an axis, and wherein each pedal, when viewed from the side, moves forward from a seating section in a forward direction relative to the seat, then moves downward to an end section, and then reverses direction and is automatically returned to an exercise start section along a reciprocating path defined by rotation about the pivot axis and extension and contraction of the arm elongation mechanism, a trajectory of each pedal being reciprocating, non-circular and characterized by having an area, and wherein the right arm and the left arm do not rotate continuously about the pivot axis and do not rotate circular during exercise.

2. The apparatus for lower body exercise according to claim 1, wherein the apparatus is incorporated into a bicycle.

3. An apparatus for lower body exercise comprising:

a frame supporting a seat, a pivot axis assembly having a pivot axis positioned proximate to the seat wherein the pivot axis assembly comprises a housing, a bearing and a pivot member, wherein the pivot member comprises a right pivot member and a left pivot member configured to rotate about the pivot axis, wherein the right pivot member and the left pivot member are coupled to enable power transmission such that the left pivot member rotates counterclockwise when the right pivot member rotates clockwise, further comprising:

a left arm and a right arm; each arm coupled to the left and right pivot members, respectively, a left arm elongation mechanism and a right arm elongation mechanism coupled to the left and right arms, respectively to allow extension and contraction of the arm, left pedal and a right pedal rotatably coupled to a distal end portion of the left and right pivot arm elongation mechanisms, respectively, and one or more resistive force generatingunits, wherein resistive force generated by the one or more resistive force generating units is transmitted to the pivot member and the arm elongation mechanism, wherein, when a user pushes each of the pedals, a length of the each arm increases relative to the each pivot member and subsequently returns to an original length, wherein the apparatus enables the user to simultaneously perform a compressing action by pushing the pedals and perform a movement in which a user's legs rotate vertically about a hip joint as an axis; and wherein each pedal, when viewed from the side, moves forward from a seating section in a forward direction relative to the seat, then moves downward to an end section, and then reverses direction and is automatically returned to an exercise start section along a reciprocating path defined by rotation about the pivot axis and extension and contraction of the arm telescopic mechanism, a trajectory of each pedal being reciprocating, non-circular and characterized by having an area; and wherein the right arm and the left arm do not rotate continuously about the pivot axis and do not rotate circular during exercise.

4. An apparatus for lower body exercise comprising, a frame supporting a seat, a pivot axis assembly having a pivot axis positioned proximate to the seat, wherein the pivot axis assembly comprises a housing, a bearing and a pivot member, wherein the pivot member comprises a right pivot member and a left pivot member configured to rotate separately from each other, a left arm and a right arm, each arm coupled to the left and right pivot members, respectively, a left arm telescopic mechanism and a right arm telescopic mechanism coupled to the left and right arms, respectively, each arm telescopic mechanism comprising an inner member and an outer member, allowing for extension and contraction of the respective arms, a left pedal and a right pedal rotatably coupled to a distal end portion of the left and right pivot arm telescopic mechanisms, respectively, one or more resistive force generating units wherein resistive force generated by the one or more resistive force generating units is transmitted to the pivot member and the arm telescopic mechanism, wherein, when a user pushes each of the pedals, a length of the each arm increases relative to the each pivot member and subsequently returns to an original length, wherein the apparatus enables the user to simultaneously perform a compressing action by pushing the pedals and perform a movement in which a user's legs rotate vertically about a hip joint as an axis; and wherein each pedal, when viewed from the side, moves forward from a seating section in a forward direction relative to the seat, then moves downward to an end section, and then reverses direction and is automatically returned to an exercise start section alone a reciprocating path defined by rotation about the pivot axis and extension and contraction of the arm telescopic mechanism, a trajectory of each pedal being reciprocating, non-circular and characterized by having an area, and wherein the right arm and the left arm do not rotate continuously about the pivot axis and do not rotate circular during exercise.

* * * * *